US011788336B2

(12) United States Patent
Kashiwagi

(10) Patent No.: US 11,788,336 B2
(45) Date of Patent: Oct. 17, 2023

(54) WINDOW REGULATOR

(71) Applicant: Johnan Manufacturing Inc., Nagano (JP)

(72) Inventor: Hideaki Kashiwagi, Nagano (JP)

(73) Assignee: JOIINAN MANUFACTURING INC., Nagano (JP)

( * ) Notice: Subject to any disclaimer, the term of this patent is extended or adjusted under 35 U.S.C. 154(b) by 0 days.

(21) Appl. No.: 17/879,668

(22) Filed: Aug. 2, 2022

(65) Prior Publication Data

US 2023/0049045 A1 Feb. 16, 2023

(30) Foreign Application Priority Data

Aug. 10, 2021 (JP) ..... 2021-130950

(51) Int. Cl.
*E05F 11/54* (2006.01)
*E05F 15/00* (2015.01)
*E05D 15/16* (2006.01)

(52) U.S. Cl.
CPC ..... *E05F 15/00* (2013.01); *E05D 15/165* (2013.01); *E05Y 2201/43* (2013.01);
(Continued)

(58) Field of Classification Search
CPC .... E05F 15/00; E05F 15/165; E05Y 2201/43; E05Y 2201/64; E05Y 2201/654; E05Y 2201/664; E05Y 2201/668; E05Y 2900/55
(Continued)

(56) References Cited

U.S. PATENT DOCUMENTS 6,088,965 A 7/2000 Fukumoto et al.
9,163,448 B2 * 10/2015 Imaoka ..... E05F 15/689
(Continued)

FOREIGN PATENT DOCUMENTS

JP S63-162085 U 10/1988
JP H4-032472 Y 8/1992
(Continued)

OTHER PUBLICATIONS

Office Action issued in corresponding Japanese Patent Application No. 2021-130950 dated Nov. 24, 2021; Revised English Translation; 7 pages.
(Continued)

*Primary Examiner* — Jerry E Redman
(74) *Attorney, Agent, or Firm* — Thomas W. Cole; Calderon Safran & Cole P.C.

(57) ABSTRACT

A window regulator includes a carrier plate, a guide rail, an ascending-side wire and a descending-side wire, a driving portion, and a turnaround portion. The driving portion includes a rotating drum, a reducer, and a driving motor including a yoke portion that is arranged to be adjacent to one side of the reducer in an orthogonal direction orthogonal to the ascending/descending direction. The guide rail is arranged so as to in the orthogonal direction overlap only the ascending-side wire fed out from a first wire feeding-out position at the one side of the rotating drum in the orthogonal direction toward the turnaround portion between the ascending-side wire and the descending-side wire fed out from a second wire feeding-out position at an other side of the rotating drum in the orthogonal direction toward the carrier plate.

2 Claims, 8 Drawing Sheets

(52) U.S. Cl.
CPC ..... *E05Y 2201/64* (2013.01); *E05Y 2201/654* (2013.01); *E05Y 2201/664* (2013.01); *E05Y 2201/668* (2013.01); *E05Y 2201/684* (2013.01); *E05Y 2900/55* (2013.01)

(58) Field of Classification Search
USPC ..... 49/352
See application file for complete search history.

(56) References Cited

U.S. PATENT DOCUMENTS

| | | | | |
|---|---|---|---|---|
| 9,255,433 | B2 * | 2/2016 | Imaoka | E05F 11/488 |
| 10,190,352 | B2 | 1/2019 | Imaoka | |
| 10,287,811 | B1 * | 5/2019 | Arimoto | E05F 11/485 |
| 10,309,140 | B2 * | 6/2019 | Imaoka | E05D 15/165 |
| 10,604,981 | B2 * | 3/2020 | Shiroma | E05F 11/486 |
| 10,822,859 | B2 * | 11/2020 | Shiroma | B60J 1/17 |
| 10,927,588 | B2 * | 2/2021 | Kashiwabara | E05F 11/486 |
| 10,927,589 | B2 * | 2/2021 | Kashiwabara | E05F 15/689 |
| 10,975,604 | B2 | 4/2021 | Kashiwagi et al. | |
| 10,975,606 | B2 * | 4/2021 | Kashiwabara | E05F 11/486 |
| 11,245,308 | B2 | 2/2022 | Uchimura et al. | |
| 11,326,381 | B2 * | 5/2022 | Tanaka | E05F 15/686 |
| 2003/0101654 | A1 * | 6/2003 | Dufour | E05F 11/486 49/352 |
| 2012/0117883 | A1 * | 5/2012 | Matsushita | E05F 11/486 49/348 |
| 2013/0227889 | A1 * | 9/2013 | Matsushita | E05F 11/483 49/352 |
| 2014/0237900 | A1 * | 8/2014 | Imaoka | F16F 15/22 49/352 |
| 2015/0101252 | A1 * | 4/2015 | Baba | E05F 11/486 49/352 |
| 2018/0112451 | A1 * | 4/2018 | Imaoka | E05F 11/486 |
| 2019/0257133 | A1 * | 8/2019 | Kashiwabara | E05F 15/689 |
| 2020/0204037 | A1 | 6/2020 | Uchimura et al. | |
| 2020/0256103 | A1 | 8/2020 | Kashiwagi et al. | |
| 2021/0054672 | A1 | 2/2021 | Tanaka et al. | |

FOREIGN PATENT DOCUMENTS

| | | | |
|---|---|---|---|
| JP | H10315760 | A | 12/1998 |
| JP | 2006028973 | A | 2/2006 |
| JP | 2010-116761 | A | 5/2010 |
| JP | 2012-031647 | A | 2/2012 |
| JP | 2012149384 | A | 8/2012 |
| JP | 2016-204944 | A | 12/2016 |
| JP | 2017008544 | A | 1/2017 |
| JP | 2019002472 | A | 1/2019 |
| JP | 6580738 | B1 | 9/2019 |
| JP | 2019-203272 | A | 11/2019 |
| JP | 2020-128658 | A | 8/2020 |
| JP | 2020-139558 | A | 9/2020 |
| JP | 2020165087 | A | 10/2020 |
| WO | 2020/174931 | A1 | 9/2020 |

OTHER PUBLICATIONS

Response to Office Action issued in corresponding Japanese Patent Application No. 2021-130950 dated Nov. 24, 2021; 10 pages.
Office Action issued in corresponding Japanese Patent Application No. 2021-130950 dated Nov. 24, 2021; 5 pages.
Decision to Grant a Patent issued in corresponding Japanese Patent Application No. 2021-130950 dated Feb. 8, 2022; 4 pages.
Notice of Dispatch of Duplicates of a Written Opposition; Description of Evidence; Statement of Opposition—filed in corresponding Japanese Patent Application No. 2021-130950 dated Jul. 20, 2022 and communicated to the applicant on Aug. 18, 2022; 28 pages.
Notice of Reasons for Revocation issued in corresponding JP Patent Application No. 2021-130950 dated Nov. 24, 2022; 29 pages.
Notice of Decision on Opposition and its English translation issued in corresponding JP Patent Application No. 2021-130950 dated Apr. 21, 2023; 95 pages.

* cited by examiner

WINDOW REGULATOR

CROSS-REFERENCES TO RELATED APPLICATIONS

The present patent application claims the priority of Japanese patent application No. 2021/130950 filed on Aug. 10, 2021, and the entire contents of Japanese patent application No. 2021/130950 are hereby incorporated by reference.

TECHNICAL FIELD

The present invention relates to a window regulator.

BACKGROUND ART

A wire driving type and lower rail type window regulator is known in which a guide rail is arranged so as to overlap with a descending-side wire (e.g., see Patent Literature 1). The window regulator includes a guide rail provided along the ascending/descending direction of vehicle window glass, a carrier plate that slides the guide rail and moves with a window glass, an ascending-side wire (ascending-side cable) and a descending-side wire (descending-side cable) that pull the carrier plate, a driving portion fixed at the lower end portion of the guide rail, and a turnaround portion (turnaround member) arranged at an upper end portion of the guide rail. The driving portion includes a drum to which one end portions of the ascending-side wire and the descending-side wire are connected, a reducer to which the drum is rotatably supported, and a driving motor comprising a yoke portion arranged to be adjacent to a left-side of the reducer. This window regulator can reduce width of the window regulator by arranging the guide rail to overlap with the descending-side wire.

CITATION LIST

Patent Literature

Patent Literature 1: JP 2019/203272 A

SUMMARY OF INVENTION

The wire driving type window regulator may cause a problem that due to an impact occurred when closing the door, the weight of the yoke portion may cause a strong moment around the guide rail as a rotational fulcrum so as to apply a strong stress to the door panel. Thereby, the door panel may be damaged or bent. Therefore, it has been needed to increase the thickness of the door panel to enhance the rigidity thereof.

It is an object of the invention to provide a window regulator that can reduce the stress applied to the door panel due to the moment caused by the weight of the yoke portion.

According to an aspect of the invention, a window regulator comprises:

a carrier plate to support a window glass of a vehicle;

a guide rail along an ascending/descending direction of the window glass to slidably support the carrier plate;

an ascending-side wire and a descending-side wire to pull the carrier plate;

a driving portion that is fixed at one end portion of the guide rail in the ascending/descending direction to drive the ascending-side wire and the descending-side wire; and a turnaround portion that is fixed at an other end portion of the guide rail in the ascending/descending direction to turn the ascending-side wire around, wherein the driving portion comprises a rotating drum to drive the ascending-side wire and the descending-side wire by rotation, a reducer rotatably support the rotating drum, and a driving motor comprising a yoke portion that is arranged to be adjacent to one side of the reducer in an orthogonal direction orthogonal to the ascending/descending direction to rotate the rotating drum through the reducer, and wherein the guide rail is arranged so as to in the orthogonal direction overlap only the ascending-side wire fed out from a first wire feeding-out position at the one side of the rotating drum in the orthogonal direction toward the turnaround portion between the ascending-side wire and the descending-side wire fed out from a second wire feeding-out position at an other side of the rotating drum in the orthogonal direction toward the carrier plate.

Advantageous Effects of Invention

According to an embodiment of the invention, a window regulator can be provided that can reduce the stress applied to the door panel due to the moment caused by the weight of the yoke portion.

DESCRIPTION OF EMBODIMENTS

The window regulator according to an embodiment of the present invention will be explained in conjunction with appended drawings as follows. This window regulator is an ascending/descending device attached to a vehicle door, which raises and lowers a vehicle window glass. Especially, the window regulator adopts a configuration to reduce moment generated by the yoke portion of the driving motor by improving a layout of the guide rail. In the following description, an ascending/descending direction, a raising direction, and a lowering direction of the window glass will be simply referred to as the ascending/descending direction, the raising direction, and the lowering direction. In addition, in the following description, as shown in drawings, the description will be explained with defining right/left, front/rear, upper/lower. In the present embodiment, the ascending/descending direction corresponds to the upper/lower direction of the window regulator, and a vehicle width direction of vehicle corresponds to the front/rear direction of the window regulator. In addition, a direction orthogonal to the ascending/descending direction and the vehicle width direction is defined as the right/left direction of the window regulator.

(Configuration of the Vehicle Door)

Herein, a vehicle door D to which the window regulator 1 is attached will be explained with referring to FIG. 1 before the explanation of window regulator 1. The vehicle door D is provided to an automobile (vehicle). In the meantime, FIG. 1 shows the vehicle door D with omitting an outer panel described below.

Figure 1:
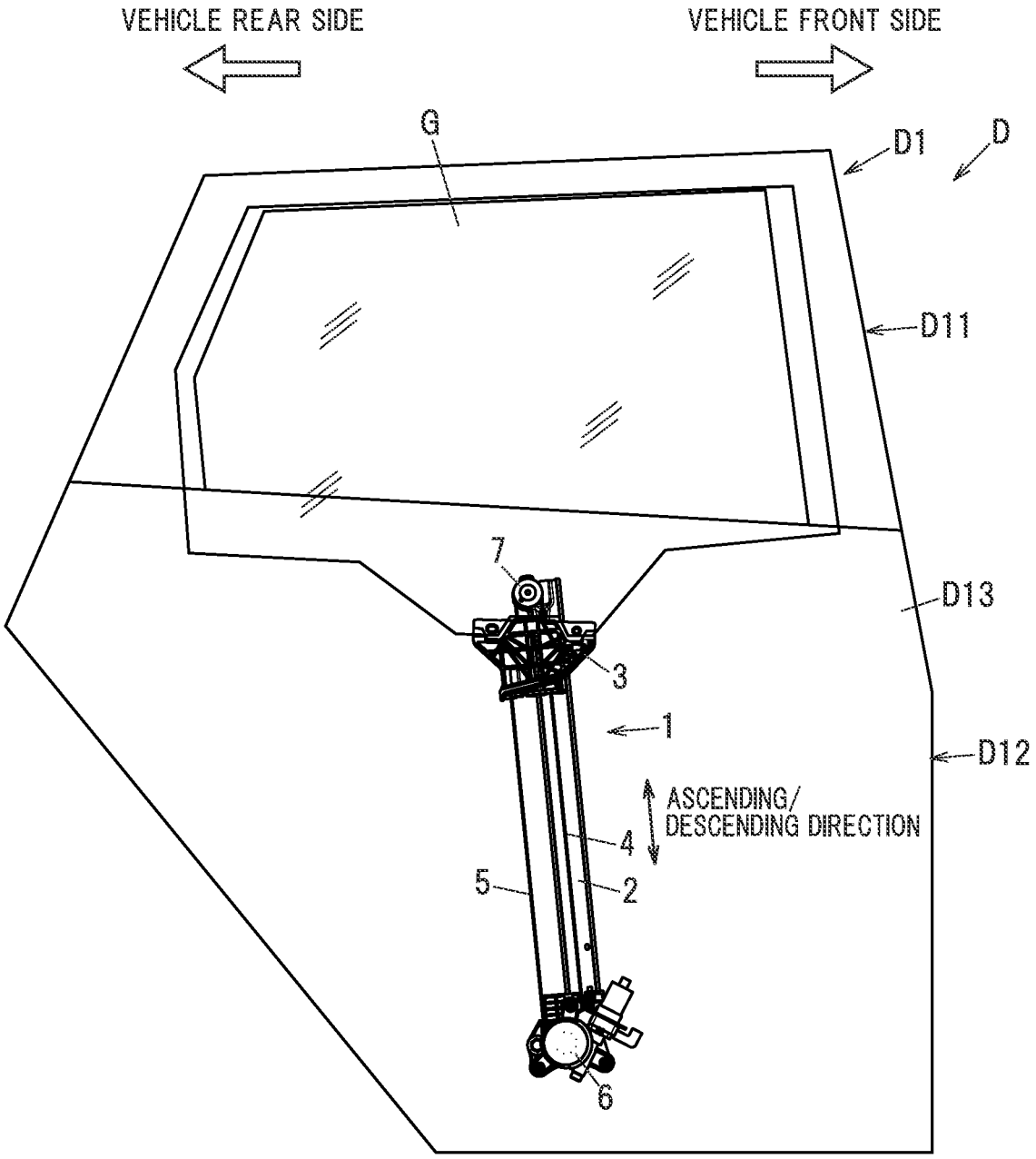
FIG. 1 is a whole schematic view showing a window regulator according to an embodiment of the present invention, and a vehicle door providing the window regulator.

As shown in FIG. 1, the vehicle door D includes a door main body D1, a vehicle window glass G supported to freely ascend and descend along a glass guide (not shown) provided to the door main body D1, a window regulator 1 that is attached to the door main body D1 to raise/lower the window glass G.

Figure 2:
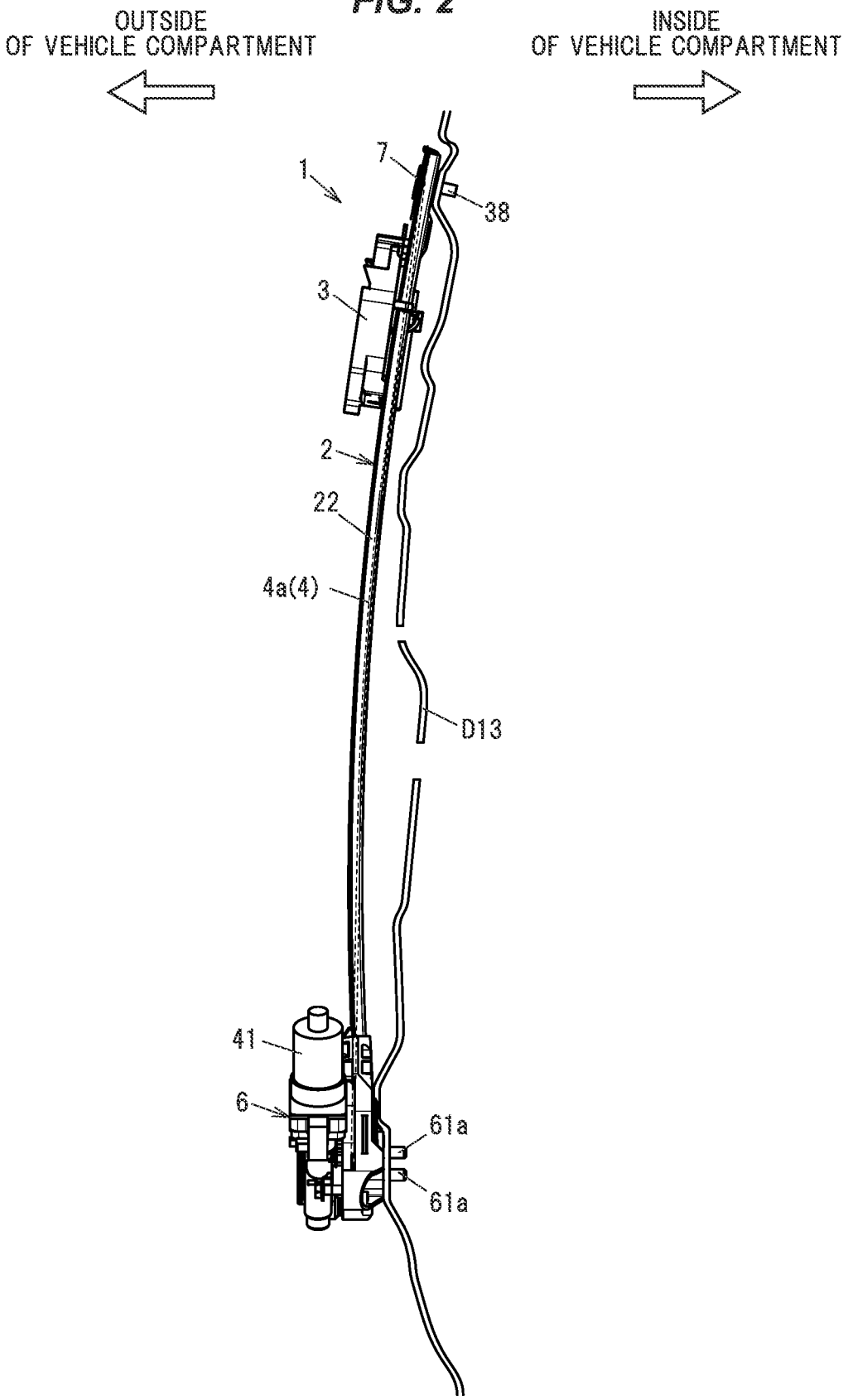
FIG. 2 is a side view showing the window regulator and an inner panel.

The door main body D1 includes a storing portion D11 storing the window glass G and a door sash D12 provided above the storing portion D11. The storing portion D11 includes an inner panel D13 serving as a door panel at an inside of the vehicle compartment, and an outer panel (not shown) at an outside of the vehicle compartment. A door inside space is defined between the inner panel D13 and the outer panel. As shown in FIG. 2, the window regulator 1 is attached to the inner panel D13 in the door inside space. In addition, as shown in FIG. 1, the window regulator 1 is attached with inclining to a rear side of vehicle front/rear direction to the door main body D1.

(Configuration of the Window Regulator)

Figure 3C:
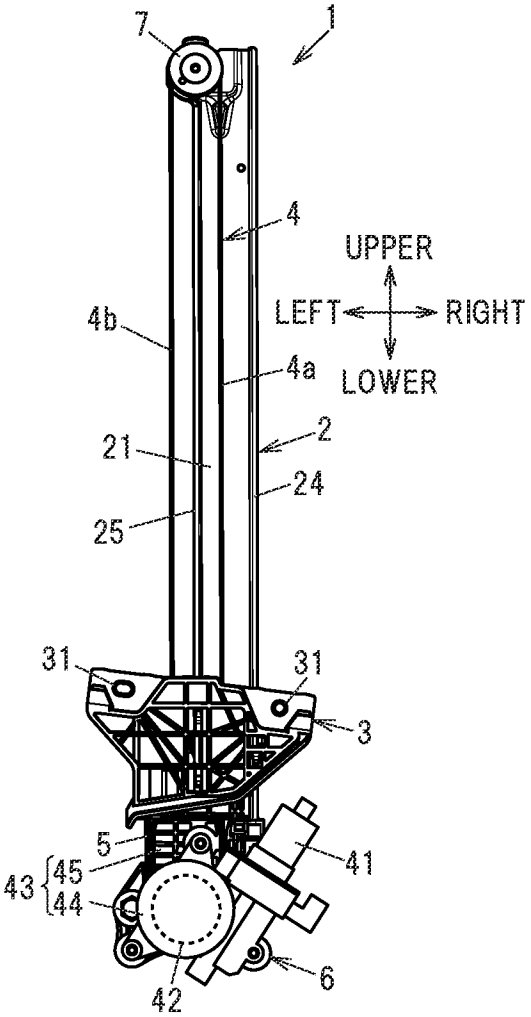
FIG. 3C is a front view showing the window regulator when the window glass is fully-opened.
Figure 3B:
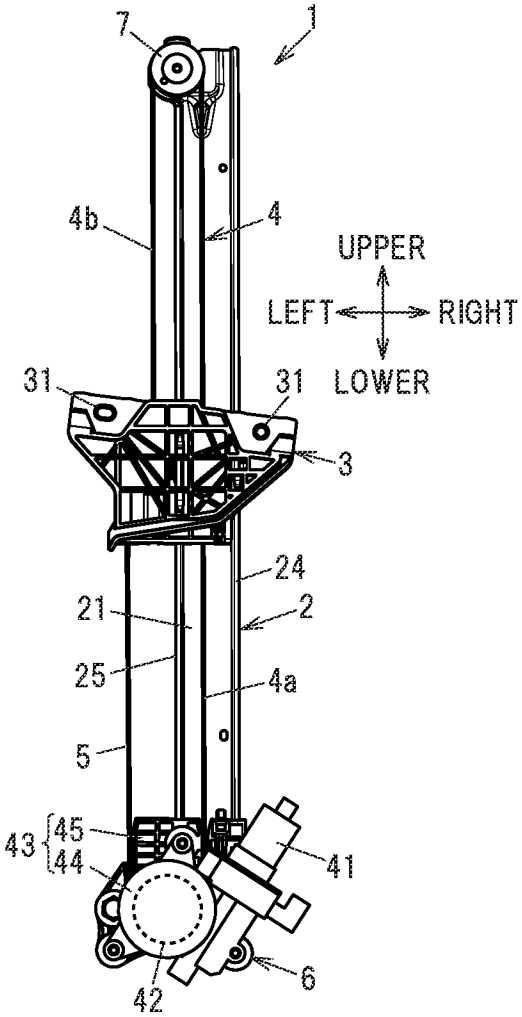
FIG. 3B is a front view showing the window regulator when the window glass is partly-opened.
Figure 3A:
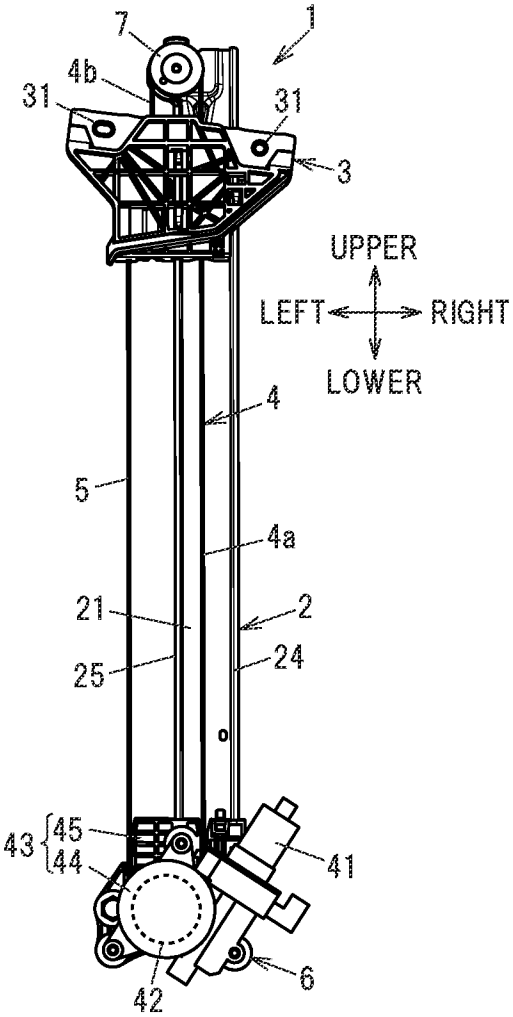
FIG. 3A is a front view showing the window regulator when a window glass is fully-closed.

As shown in FIGS. 3A to 3C, the window regulator 1 includes a guide rail 2 provided along the ascending/descending direction, a carrier plate 3 that supports the window glass G and is slidably attached to the guide rail 2, an ascending-side wire 4 and a descending-side wire 5 that pull the carrier plate 3, and ascend/descend the carrier plate 3 along the guide rail 2, a driving portion 6 that is arranged at a lower end portion of the guide rail 2 (one end portion in the ascending/descending direction) and drives the ascending-side wire 4 and the descending-side wire 5, and a pulley 7 (turnaround portion) that is arranged at an upper end portion of the guide rail 2 (another end portion in the ascending/descending direction) to turn the ascending-side wire 4 around.

In addition, as shown in FIGS. 4A to 4D, the window regulator 1 includes an ascending-side sliding bush 11 attached to a carrier plate 3 side end portion of the ascending-side wire 4, an ascending-side spring 12 providing tension to the ascending-side wire 4 through the ascending-side sliding bush 11, a descending-side sliding bush 13 attached to a carrier plate 3 side end portion of the descending-side wire 5, and a descending-side spring 14 providing tension to the ascending-side wire 4 through the descending-side sliding bush 13. That is, the window regulator 1 serves as a wire driving window regulator that ascends/descends the carrier plate 3 by using the wires 4, 5, and is a lower end rail type window regulator arranging the driving portion 6 at the lower end portion of the guide rail 2.

As shown in FIG. 2, the guide rail 2 is a long-ranged metal member extended along the ascending/descending direction. The upper end portion of the guide rail 2 is fixed to the inner panel D13, and the lower end portion of that is fixed to the driving portion 6 (a drum housing 44 of the driving portion 6). In addition, the guide rail 2 is curved to protrude toward a vehicle exterior direction in the vehicle width.

Figure 4A:
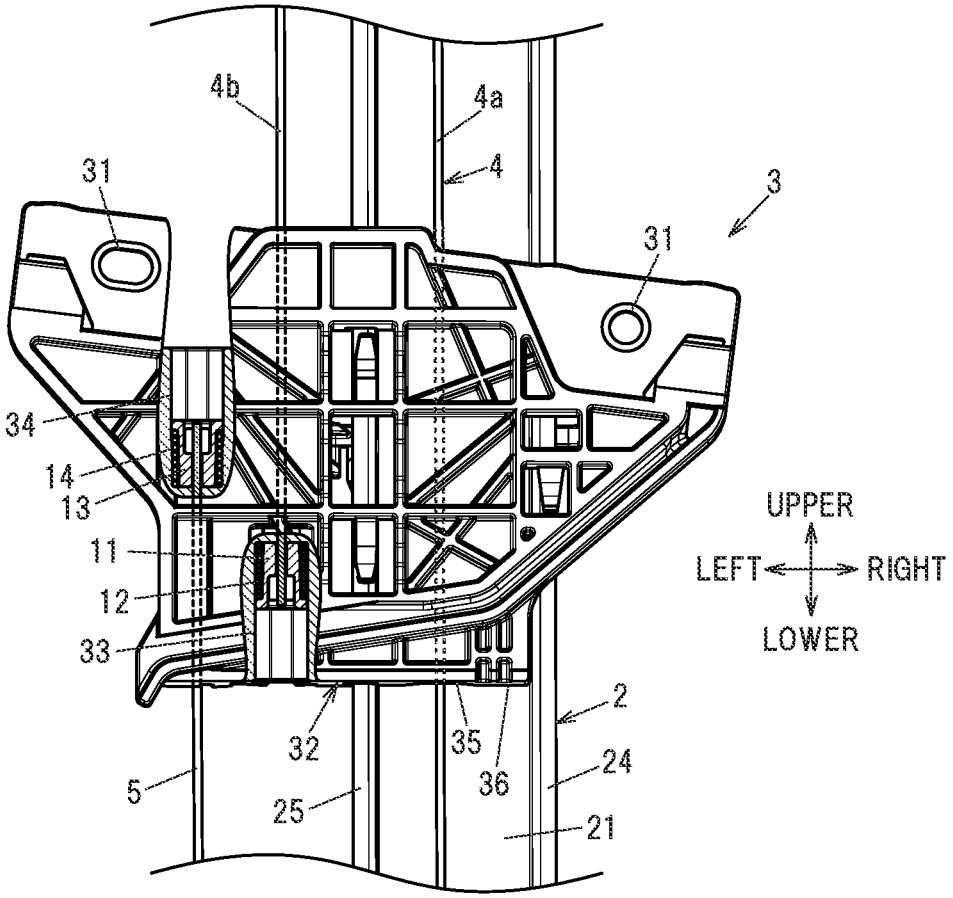
FIG. 4A is a front view showing a periphery of a carrier plate.
Figure 4B:
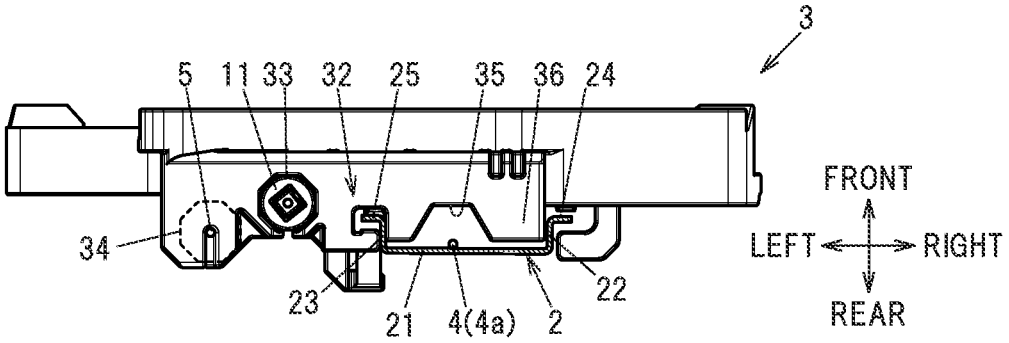
FIG. 4B is a bottom view showing a periphery of the carrier plate when the window glass is partly-opened.
Figure 5A:
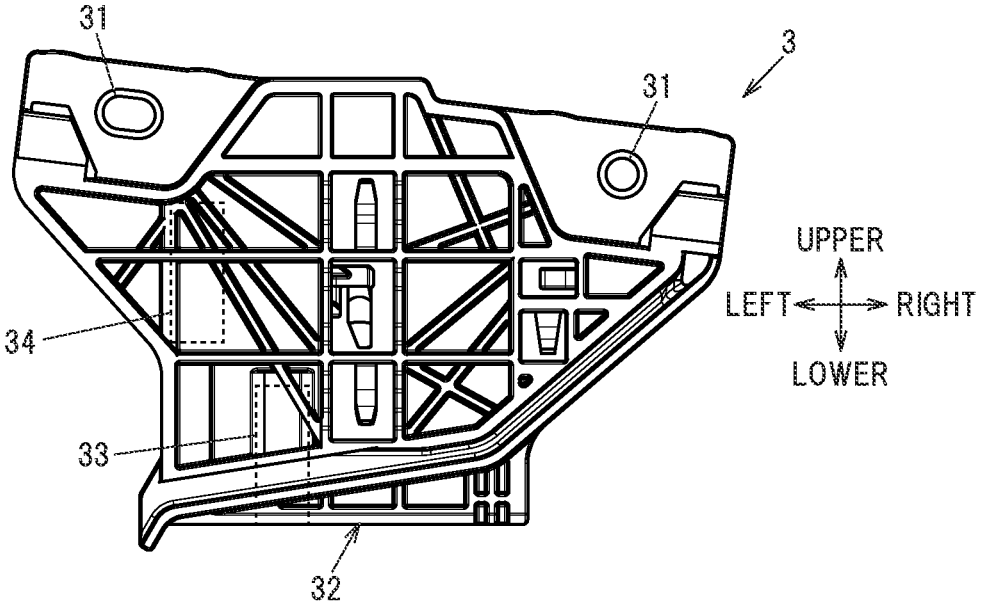
FIG. 5A is a front view showing the carrier plate.
Figure 5B:
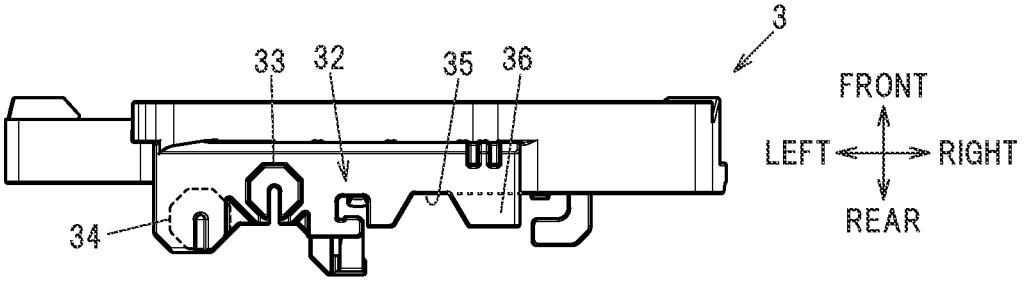
FIG. 5B is a bottom view showing the carrier plate.
Figure 5C:
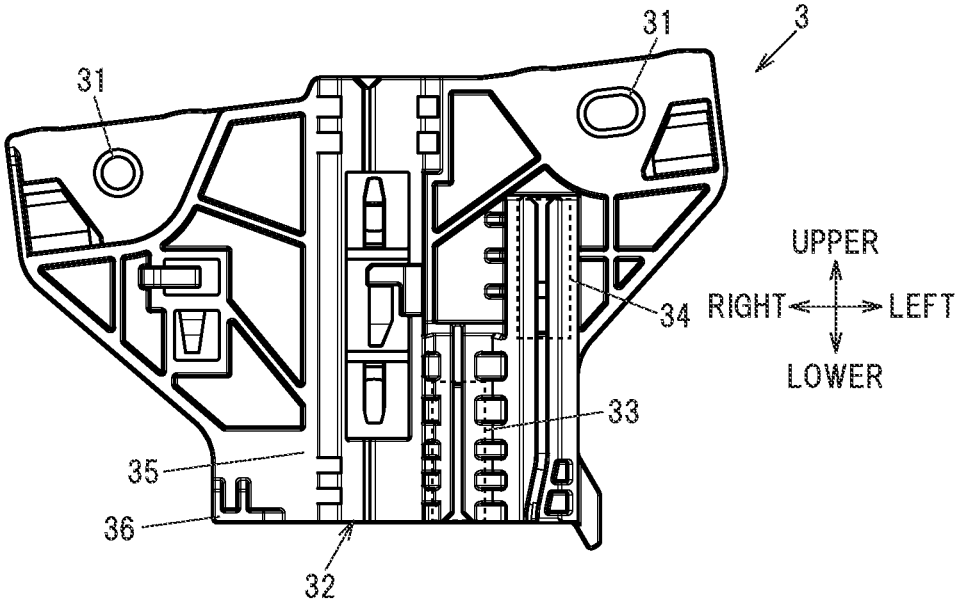
FIG. 5C is a rear view showing the carrier plate.

As shown in FIGS. 4A, 4B, the guide rail 2 includes a plate portion 21 extended in the ascending/descending direction, a right-side plate portion 22 and a left-side plate portion 23 that are stand toward a front side from right/left end portions in a short end direction of the plate portion 21 (a direction orthogonal to the ascending/descending direction), a right flange portion 24 extended to a right side from a front end of the right-side plate portion 22, and a left flange portion 25 extended to a left side from a front end of the left-side plate portion 23. The guide rail 2 slidably supports the carrier plate 3 in the left-side plate portion 23.

As shown in FIGS. 3A to 3C, one end portion of the ascending-side wire 4 is connected to a rotating drum 42 (described below) of the driving portion 6 and another end portion of that is connected to the carrier plate 3 when the ascending-side wire 4 is fed out upward and reaches to the pulley 7 and then turns downward by the pulley 7. In the meantime, one end portion of the descending-side wire 5 is connected to the rotating drum 42 of the driving portion 6 and is fed out from the driving portion 6, and another end portion of that is attached to the carrier plate 3.

In addition, an ascending-side wire 4*a* arranged between the driving portion 6 and the pulley 7 from the ascending-side wire 4 is located on the plate portion 21 of the guide rail 2 and is overlapped on the plate portion 21 of the guide rail in viewed from the vehicle width direction (a rotational axis direction of the rotating drum 42). As described above, since the guide rail 2 is curved toward the vehicle width direction, the ascending-side wire 4*a* arranged between the driving portion 6 and the pulley 7 pushes and contacts a middle portion in the upper/lower direction of the plate portion 21 of the guide rail 2 (see e.g., FIG. 2). Hereby, the plate portion 21 of the guide rail 2 serves as a wire supporting configuration supporting the ascending-side wire 4*a* arranged between the driving portion 6 and the pulley 7 at the middle portion in the upper/lower direction. In the meantime, the ascending-side wire 4*b* arranged between the pulley 7 and the carrier plate 3 from the ascending-side wire 4 and the descending-side wire 5 are located at a position shifted from the guide rail 2. The ascending-side wire 4*b* and the descending-side wire 5 are shifted from the guide rail 2 in a right/left direction in viewed from the vehicle width direction (the rotational axis direction of the rotating drum 42).

As shown in FIGS. 4A, 4B and 5A to 5C, the carrier plate 3 is a plate-shaped member formed of resins such as polyacetal, and the carrier plate 3 is arranged to face the plate portion 21 of the guide rail 2. Two right and left attaching holes 31 to attach the window glass G, a rail attaching portion 32 arranged at a center in a right/left direction of a rear surface side (back side in FIGS. 4A, 4B), an ascending-side housing portion 33 arranged at a left side of the rail attaching portion 32, a descending-side housing portion 34 arranged at a left side of ascending-side housing portion 33, a notch portion 35 avoiding the ascending-side wire 4*a* on the plate portion 21 of the guide rail 2, which is arranged at a right side of the rail attaching portion 32 in a rear surface side, and a contacted portion 36 on which a position regulating portion 64 of the driving portion 6 is contacted, and which is arranged at a right side lower end portion of the notch portion 35.

The attaching holes 31 are for bolt fasting a glass holder (not shown) fixed on the window glass G. The window glass G is attached to the carrier plate 3 through the glass holder by fasting the glass holder to the attaching holes 31 by bolts.

The rail attaching portion 32 is slidably attached to the left-side plate portion 23 of the guide rail 2. That is, the rail attaching portion 32 is supported by the rail attaching portion 32 to freely ascend and descend against the left-side plate portion 23 of the guide rail 2.

As shown in FIGS. 4A, 4B, the ascending-side housing portion 33 houses the ascending-side sliding bush 11 and the ascending-side spring 12. Hereby, a carrier plate 3 side end of the ascending-side wire 4 is attached to the ascending-side housing portion 33 through the ascending-side sliding bush 11 and the ascending-side spring 12. In the meantime, the descending-side housing portion 34 houses the descending-side sliding bush 13 and the descending-side spring 14. Hereby, a carrier plate 3 side end of the descending-side wire 5 is attached to the descending-side housing portion 34 through the descending-side sliding bush 13 and the descending-side spring 14.

The notch portion 35 is extended in the ascending/descending direction such that the carrier plate 3 does not contact the ascending-side wire 4*a* arranged between the driving portion 6 and the pulley 7. Since disjunction of the ascending-side wire 4*a* arranged between the driving portion 6 and the pulley 7 against the guide rail 2 is different depending on a position on the guide rail 2 in the ascending/descending direction, a depth of the notch portion 35 in the front/rear direction is a depth such that the ascending-side wire 4*a* does not contact the carrier plate 3 even when the carrier plate 3 is located at an upper end position or an lower end portion of the guide rail 2 where the ascending-side wire 4*a* is the farthest from the guide rail 2 (when the window glass G is fully-opened or fully-closed).

Figure 6A:
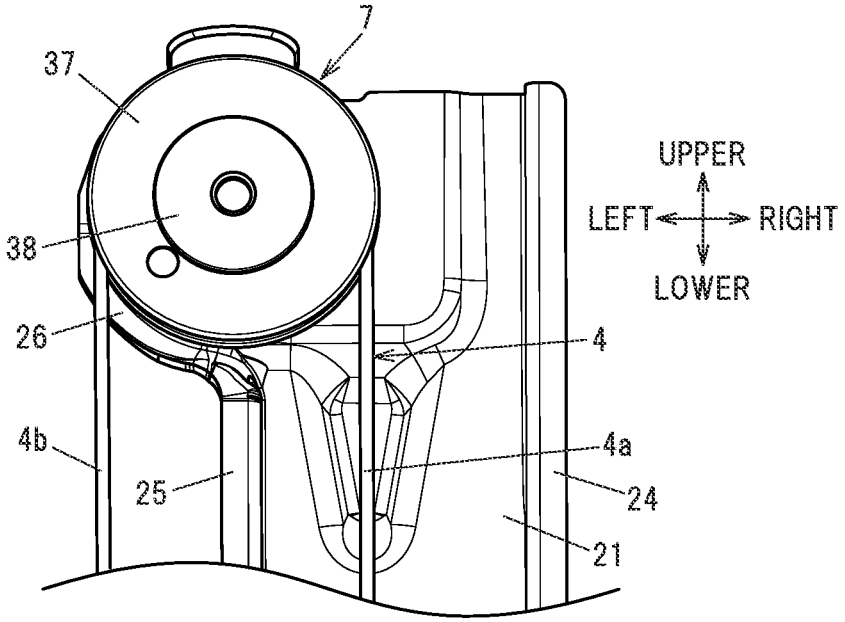
FIG. 6A is a front view showing a periphery of a pulley.
Figure 6B:
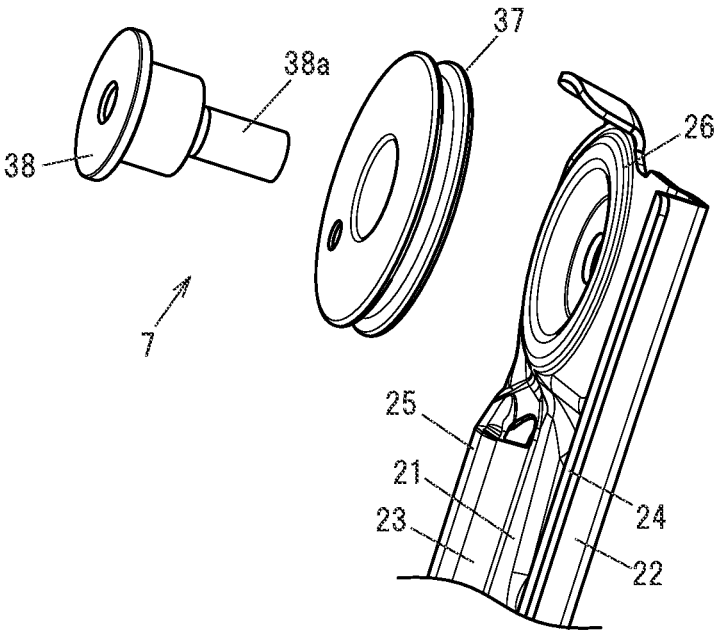
FIG. 6B is an exploded perspective view showing a periphery of the pulley.

As shown in FIGS. 6A and 6B, the pulley 7 includes a pulley main body 37 winding and turning the ascending-side wire 4, a pulley shaft 38 rotatably supporting the pulley main body 37.

The pulley shaft 38 is fixed on a pulley supporting portion 26 arranged on the upper end portion of the guide rail 2 to pass through the pulley supporting portion 26. In addition, a bolt portion 38*a* to be fixed to the inner panel D13 is formed at a tip end (rear end) of the pulley shaft 38. Thus, as shown in FIG. 2, the upper end portion of the guide rail 2 is fixed to the inner panel D13 by the pulley shaft 38.

Figure 7A:
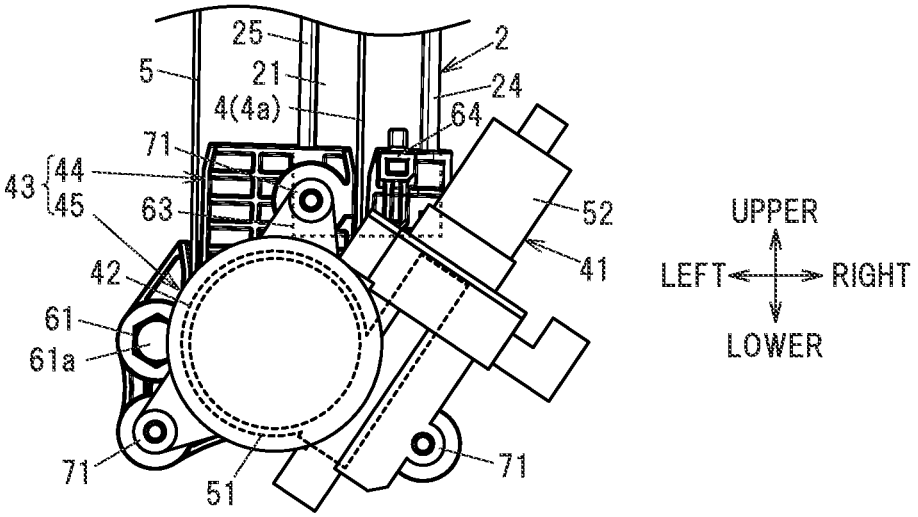
FIG. 7A is a front view showing a periphery of a driving portion.
Figure 7B:
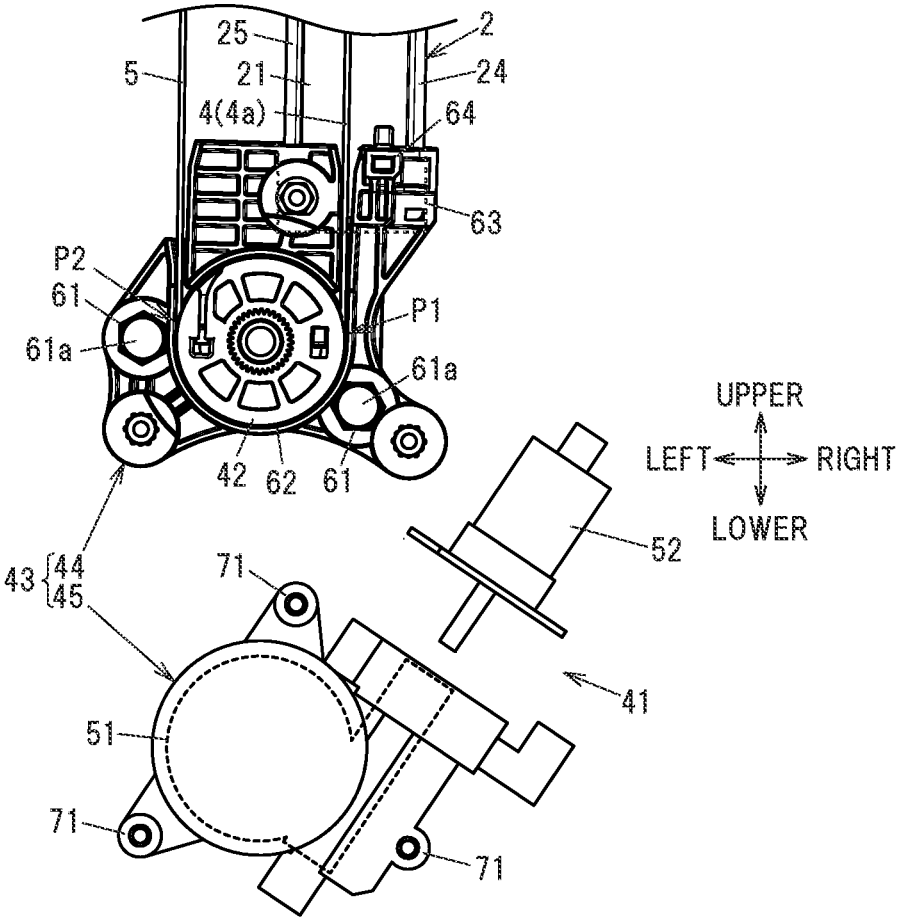
FIG. 7B is an exploded view showing a periphery of the driving portion.
Figure 8:
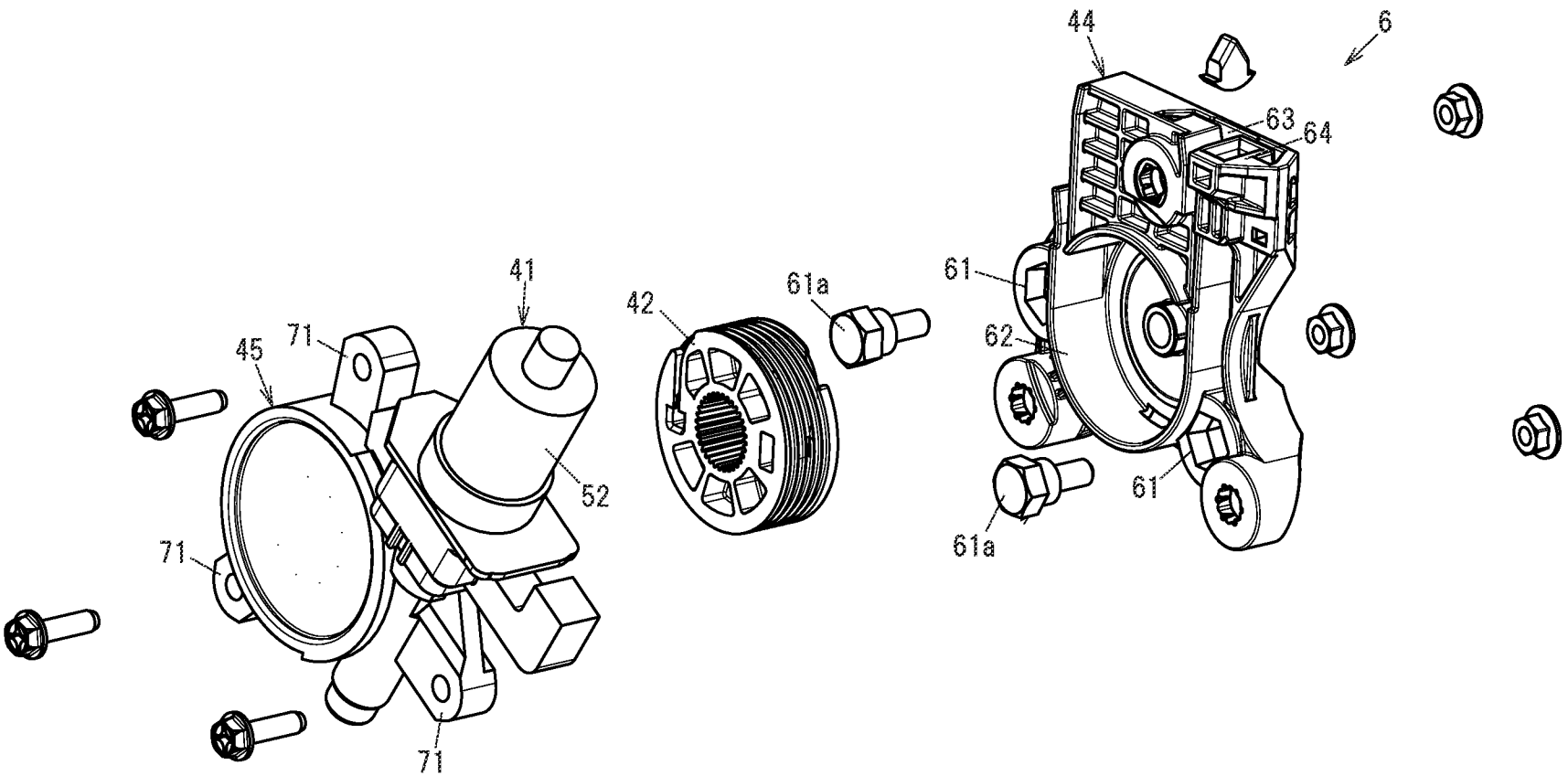
FIG. 8 is an exploded perspective view showing the driving portion.

As shown in FIGS. 7A to 8, the driving portion 6 includes a driving motor 41 having a reducer 51, which can forward/reverse rotationally drive, a resin rotating drum 42 rotationally driven by the driving motor 41, and a resin housing 43 to house the rotating drum 42 and hold the driving motor 41. The housing 43 includes a drum housing 44 that fits the lower end portion of the guide rail 2 and rotatably houses the rotating drum 42, and a motor housing 45 to hold the driving motor 41.

Driving portion 6 side end portions of the ascending-side wire 4 and the descending-side wire 5 are connected to the rotating drum 42. The ascending-side wire 4 and the descending-side wire 5 are took up and fed out by rotating the rotating drum 42. In addition, the rotating drum 42 is configured to feed out the ascending-side wire 4 from a right-side wire feeding-out position P1 (first wire feeding-out position) and the descending-side wire 5 from a left-side wire feeding-out position P2 (second wire feeding-out position). The right-side wire feeding-out position P1 of the rotating drum 42 (the wire feeding-out position of the ascending-side wire 4) is overlapped with the guide rail 2 in the right/left direction (an orthogonal direction orthogonal to the ascending/descending direction). In the meantime, the left-side wire feeding-out position P2 of the rotating drum 42 (the wire feeding-out position of the descending-side wire 5) shifts from the guide rail 2 in the right/left direction. Hereby, only the ascending-side wire 4*a* fed out from the right-side wire feeding-out position P1 of the rotating drum 42 to the pulley 7 from the ascending-side wire 4*a* fed out from the right-side wire feeding-out position P1 of the rotating drum 42 and the descending-side wire 5 fed out from the left-side wire feeding-out position P2 of the rotating drum 42 to the carrier plate 3 is configured to overlap the guide rail 2.

The driving motor 41 includes the resin reducer 51 mounted in the motor housing 45 and rotatably supporting the rotating drum 42 to an output axis, and a yoke portion 52 (motor main body) arranged to be adjacent to a right-side of the reducer 51 and rotating the rotating drum 42 through the reducer 51. The yoke portion 52 includes a core formed by laminating sheet metals, copper wires wound around the core, magnets generating magnetic field around the core, and a metal yoke to hold the magnets. Most parts are weight bodies made from metal parts. Especially, since the other parts of the driving portion 6 and the driving motor 41 (the reducer 51, the rotating drum 42, and the housing 43) are formed of resin, and on the other hand, the yoke portion 52 is mainly made from metal parts, the yoke portion 52 is a heavy weight body in the driving portion 6 and the driving motor 41. Furthermore, the yoke portion 52 is the heavy weight body in the window regulator 1.

When the driving motor 41 is forward driven, the rotating drum 42 forward rotates and the descending-side wire 5 is fed out and the ascending-side wire 4 is wound in accordance with the rotation. Hereby, the carrier plate 3 is pulled by the ascending-side wire 4 and moves in the raising direction. Thus, the window glass G attached to the carrier plate 3 ascends (ascending movement of the window glass G). In the meantime, when the driving motor 41 is reverse driven, the rotating drum 42 reverses and the ascending-side wire 4 is fed out and the descending-side wire 5 is wound in accordance with the rotation. Hereby, the carrier plate 3 is pulled by the descending-side wire 5 and moves in the lower direction. Thus, the window glass G attached to the carrier plate 3 descends (descending movement of the window glass G). Therefore, the carrier plate 3 and the window glass G are ascended/descended along the guide rail 2 by such configuration.

Two fixing holes 61 to fix the drum housing 44 to the inner panel D13 by bolts 61*a*, a drum housing portion 62 to rotatably house the rotating drum 42, a fitting hole 63 arranged at upper right of the drum housing portion 62 and fitting the lower end portion of the guide rail 2, and a position regulating portion 64 arranged at a front side of the fitting hole 63 (front side in FIG. 7A). The position regulating portion 64 regulates moving the carrier plate 3 to lower end by contacting the contacted portion 36 of the carrier plate 3 when the window glass G is fully-opened.

The fitting hole 63 fits to the lower end portion of the guide rail 2. The lower end portion of the guide rail 2 is fixed to the drum housing 44 by the fitting hole 63. Since the fitting hole 63 is arranged to the right-side wire feeding-out position P1 of the rotating drum 42 housed in the drum housing portion 62 in the right/left direction (a direction orthogonal to the ascending/descending direction and the vehicle width direction), the guide rail 2 fit to the fitting hole 63 is arranged to overlap the right-side wire feeding-out position P1 of the rotating drum 42 in the right/left direction. Thus, the guide rail 2 is configured to overlap the ascending-side wire 4*a* fed out from the right-side wire feeding-out position P1 to the pulley 7 in the right/left direction. Hereby, the guide rail 2 can close to the yoke portion 52 of the driving motor 41. In the present embodiment, the guide rail 2 and the yoke portion 52 are arranged to overlap each other in the right/left direction.

The motor housing 45 mounts the reducer 51 and covers an opening of the drum housing portion 62 of the drum housing 44 while rotatably supporting the output axis of the reducer 51. In addition, three fixing portions 71 to fix the motor housing 45 to the drum housing 44 is formed in the motor housing 45. In the meantime, a part of the three fixing portions 71 is arranged at a position overlapped with the guide rail 2 in the right/left direction.

Effects of the Embodiment

As described above, according to the configuration in the above embodiment, it is possible to reduce the width of the window regulator 1 and reduce stress to the inner panel D13 generated by moment caused by the weight of the yoke portion 52 by arranging the guide rail 2 to overlap the ascending-side wire 4*a* fed out from the right-side wire feeding-out position P1 to the pulley 7 from the ascending-side wire 4*a* fed out from the right-side wire feeding-out position P1 of the rotating drum 42 to the pulley 7 and the descending-side wire 5 fed out from the left-side wire feeding-out position P2 to the carrier plate 3. That is, large inertia force in the vehicle width direction is generated at the yoke portion 52 that is a heavy weight part caused by impact in closing the vehicle door D, and thus moment of which the yoke portion 52 is a force point, the guide rail 2 is a rotational fulcrum (rotational axis), and fixing parts to the inner panel D13 (the fixing holes 61, and the bolt portion 38*a* of the pulley shaft 38) are the point of action is generated. Thus, as the distance between the yoke portion 52 and the guide rail 2 is greater in the right/left direction (the orthogonal direction orthogonal to the ascending/descending direction), large stress is generated to the inner panel D13 by Lever principle. In the meantime, for the configuration according to the above embodiment, since the guide rail 2 is configured to overlap the ascending-side wire 4*a* fed out from the right-side wire feeding-out position P1 of the rotating drum 42 in the configuration that the yoke portion 52 is adjacent to the right-side of the reducer 51, it is possible for the yoke portion 52 to be close to the guide rail 2, and reduce the stress to the inner panel D13 generated by the moment caused by the weight of the yoke portion 52 in closing the vehicle door D. Thus, it is possible to prevent the inner panel D13 from breaking and curving. In addition, for the conventional window regulator, vibration in twisting direction of the guide rail 2 caused by the weight of the yoke portion 52 is generated by impact in closing the vehicle door D, and thus it may generate hitting sound caused by contacting the guide rail 2 with the carrier plate 3. However, it is possible to reduce the vibration of the guide rail 2 caused by the weight of the yoke portion 52 and also preventing the occurrence of twist of the guide rail 2 and hitting sound between the guide rail 2 and the carrier plate 3 caused by the twist by closing the yoke portion 52 to the guide rail 2 in the right/left direction. In addition, considering these effects, it is preferable to define the distance between the yoke portion 52 (for example, the center of that) and the guide rail 2 (for example, the center of that) in the right/left direction to the length shorter than the distance between the guide rail 2 (for example, the center of that) and the fixing parts to the inner panel D13 (for example, the center of that) in the right/left direction.

In addition, since only the ascending-side wire 4*a* arranged between the driving portion 6 and the pulley 7 from the ascending-side wire 4*a* arranged between the driving portion 6 and the pulley 7, the ascending-side wire 4*b* arranged between the pulley 7 and the carrier plate 3, and the descending-side wire 5 is configured to be located on the guide rail 2, it is possible to decrease width (width in the right/left direction) of the guide rail 2. Thus, weight of the window regulator 1 can further reduce.

OTHER EMBODIMENTS

Although the embodiment of the invention has been described, the invention according to claims is not to be limited to the embodiment described above. Further, please note that all combinations of the features described in the embodiment are not necessary to solve the problem of the invention. The invention can be appropriately modified and implemented without departing from the gist thereof.

REFERENCE SIGNS LIST

1 WINDOW REGULATOR
2 GUIDE RAIL
3 CARRIER PLATE
4 ASCENDING-SIDE WIRE
4*a* ASCENDING-SIDE WIRE ARRANGED BETWEEN PULLEY AND DRIVING PORTION
5 DESCENDING-SIDE WIRE
6 DRIVING PORTION
7 PULLEY
41 DRIVING MOTOR
42 ROTATING DRUM
51 REDUCER
52 YOKE PORTION
G WINDOW GLASS
P1 RIGHT-SIDE WIRE FEEDING-OUT POSITION
P2 LEFT-SIDE WIRE FEEDING-OUT POSITION

The invention claimed is:

1. A window regulator, comprising:

a carrier plate to support a window glass of a vehicle;

a guide rail along an ascending/descending direction of the window glass to slidably support the carrier plate, the guide rail including a plate portion extended in the ascending/descending direction and a side plate portion that extends from an edge portion in a direction orthogonal to the ascending/descending direction, the side plate portion slidably supporting the carrier plate;

an ascending-side wire and a descending-side wire to pull the carrier plate;

a driving portion that is fixed at one end portion of the guide rail in the ascending/descending direction to drive the ascending-side wire and the descending-side wire; and a turnaround portion that is fixed at another end portion of the guide rail in the ascending/descending direction to turn the ascending-side wire around, wherein the driving portion comprises a rotating drum to drive the ascending-side wire and the descending-side wire by rotation, a reducer rotatably support the rotating drum, and a driving motor comprising a yoke portion that is arranged to be adjacent to a first side of the reducer in an orthogonal direction orthogonal to the ascending/descending direction to rotate the rotating drum through the reducer, wherein the ascending-side wire fed out from a first wire feeding-out position at the first side of the rotating drum in the orthogonal direction toward the turnaround portion is in the orthogonal direction closer to the yoke portion than the descending-side wire fed out from a second wire feeding-out position at a second side of the rotating drum in the orthogonal direction toward the carrier plate, and wherein the guide rail is arranged so that the plate portion overlaps the ascending-side wire fed out from the first wire feeding-out position toward the turnaround portion as viewed from a rotational axis direction of the rotating drum and so that the plate portion does not overlap the descending-side wire fed out from the second wire feeding-out position toward the carrier plate as viewed from the rotational axis direction of the rotating drum.

2. The window regulator according to claim 1, wherein the guide rail and the yoke portion are arranged so as to overlap each other in the orthogonal direction.

* * * * *